US008167958B2

(12) United States Patent
Meyer et al.

(10) Patent No.: US 8,167,958 B2
(45) Date of Patent: May 1, 2012

(54) MULTIPLE STEP DYEING TEXTILE WITH CONCENTRATED DYE SYSTEMS

(75) Inventors: Christian Meyer, Viersen (DE); Wolfgang Schrott, Ludwigshafer (DE); Franz Sütsch, Rödersheim-Gronau (DE)

(73) Assignee: DyStar Colours Deutschland GmbH (DE)

( * ) Notice: Subject to any disclaimer, the term of this patent is extended or adjusted under 35 U.S.C. 154(b) by 0 days.

(21) Appl. No.: 13/059,496

(22) PCT Filed: Aug. 14, 2009

(86) PCT No.: PCT/EP2009/060528

§ 371 (c)(1), (2), (4) Date: Mar. 7, 2011

(87) PCT Pub. No.: WO2010/023113

PCT Pub. Date: Mar. 4, 2010

(65) Prior Publication Data

US 2011/0289697 A1 Dec. 1, 2011

(30) Foreign Application Priority Data

Aug. 23, 2008 (DE) ..... 10 2008 039 500

(51) Int. Cl.
*D06P 5/00* (2006.01)

(52) U.S. Cl. ..... 8/504; 8/477; 8/485; 8/536; 8/917; 8/918

(58) Field of Classification Search ..... 8/504, 477, 8/485, 536, 917, 918
See application file for complete search history.

(56) References Cited

U.S. PATENT DOCUMENTS

| | | | | |
|---|---|---|---|---|
| 4,118,526 | A | 10/1978 | Gregorian et al. | |
| 4,613,335 | A | 9/1986 | Berendt et al. | |
| 5,917,120 | A * | 6/1999 | Rommel et al. | 8/485 |
| 6,090,166 | A | 7/2000 | Girbaud et al. | |
| 6,428,581 | B1 | 8/2002 | Gang et al. | |

FOREIGN PATENT DOCUMENTS

| | | |
|---|---|---|
| DE | 2523062 | 12/1976 |
| EP | 0162018 | 11/1985 |
| EP | 1591578 | 11/2005 |
| WO | WO-2007/080134 | 7/2007 |
| WO | WO-2008/056256 | 5/2008 |

* cited by examiner

*Primary Examiner* — Eisa Elhilo
(74) *Attorney, Agent, or Firm* — Connolly Bove Lodge & Hutz LLP

(57) ABSTRACT

The present invention relates to a process for dyeing sheetlike textile materials with a dye, which comprises a concentrated dye system being applied in a total amount of 1% to 25% by weight, based on the textile material, to the textile material in two or more sub-steps and the dye being fixed on the textile material after each and every sub-step.

18 Claims, 1 Drawing Sheet

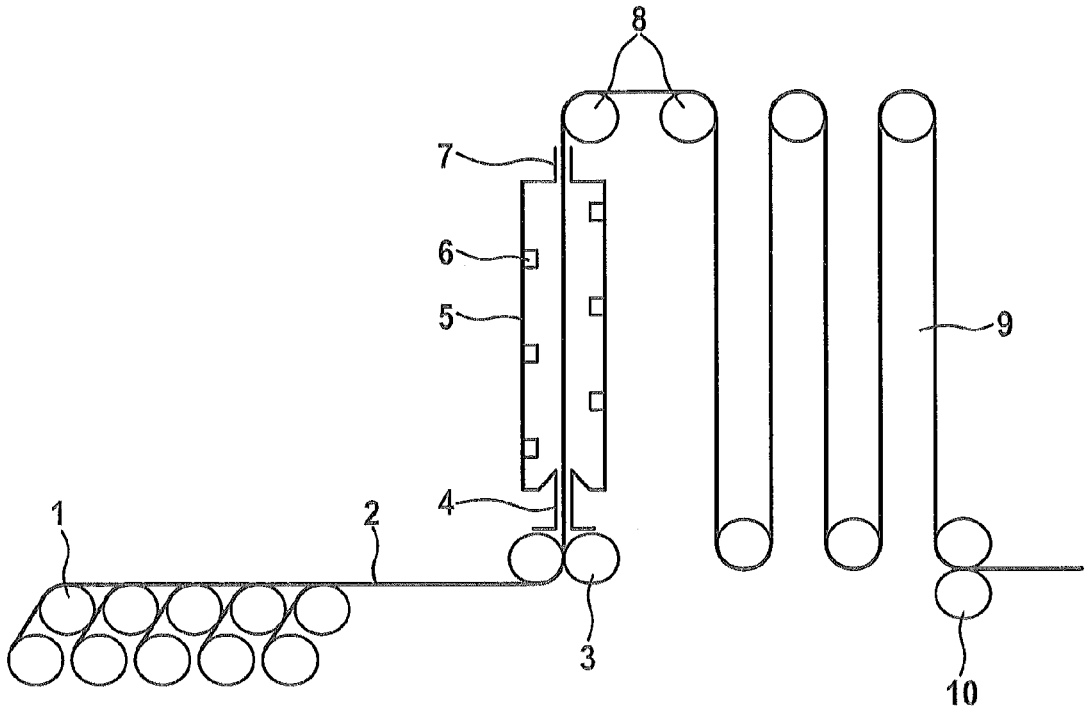
8
7
6
5
9
4
1
2
3
10

MULTIPLE STEP DYEING TEXTILE WITH CONCENTRATED DYE SYSTEMS

CROSS-REFERENCE TO RELATED APPLICATIONS

This application is a national stage application (under 35 U.S.C. §371) of PCT/EP2009/060528, filed Aug. 14, 2009, which claims benefit of German application 10 2008 039 500.5, filed Aug. 23, 2008

BACKGROUND OF THE INVENTION

The present invention relates to the technical field of dyeing textile materials.

A large proportion of the impacts caused by the textile industry is due to present-day dyeing and finishing processes, which consume large amounts of water and textile auxiliaries. All that continued optimization of existing processes could hope to achieve appears to be at best a marginal improvement with regard to minimizing environmental impact.

Dyeing denim articles with indigo is of particular interest in this context, since this art usually utilizes large-scale industrial dyeing ranges that have large capacities and thus also large water requirements and wastewater impacts.

State of the art involves a continuous exhaust dyeing process to dye individual threads made up in the form of a sheet of threads (warp threads), as needed for weaving, or in the form of a rope which combines 300 to 400 warp threads in one rope. In this continuous exhaust dyeing process, the substrate is continuously led through the dyebath (hereinafter also referred to as liquor) and, before attainment of the concentration equilibrium, separated again from the liquor. After this separation, the dye which has already gone onto the warp threads is oxidized to convert it into its insoluble form and thereby fixed on the substrate. In the further course of the dyeing process, the warp threads are again introduced into the liquor and the exhaust process starts once more. The oxidized dye already present in the warp threads does not take part in this renewed dyeing operation, and therefore a further "layer" of reduced dye can exhaust from the liquor onto the warp threads above the oxidized first layer of dye. This buildup layer by layer ultimately makes it possible to achieve a high concentration of the dye on the warp threads.

These processes are carried out for warp threads in open-width dyeing machines and for ropes of threads in rope dyeing machines, which involve liquor volumes of 5000 to 7000 liters and have appreciable requirements in terms of heating energy, electricity and processing chemicals.

In addition, the low fastness level achieved with existing processes of dyeing denim with indigo is an irksome problem for the industry and for the consumer, particularly in relation to dry and wet rub fastnesses.

Finally, the processes mentioned are technically demanding in that a multiplicity of mutually interacting parameters have to be captured and policed at great cost and inconvenience in terms of the measuring and control technology needed.

There is accordingly an appreciable demand for dyeing processes for dyeing textile material which require distinctly less water and energy, are technically simpler to handle and yet provide dyeings of better quality.

The present invention, then, provides a process which leads to a distinct reduction in water and energy requirements and which generates less textile waste. This makes it significantly more environment-friendly and economical than existing processes. The process of the present invention, what is more, leads to a distinct increase in fastnesses, particularly rub fastness.

BRIEF SUMMARY OF THE INVENTION

The present invention relates to a process for dyeing sheetlike textile materials with a dye, which comprises a concentrated dye system being applied in a total amount of 1% to 25% by weight, based on the textile material, to the textile material in two or more sub-steps and the dye being fixed on the textile material after each and every sub-step.

A BRIEF DESCRIPTION OF THE FIGURE

FIG. 1 shows a course of the process of the present invention as exemplified for dyeing cotton warp threads with indigo in a vertical aerosol chamber.

DETAILED DESCRIPTION OF THE INVENTION

For the purposes of the present invention, sheetlike textile materials are, in particular, natural materials such as cotton, wool, linen, hemp, sisal, kapok, but also materials such as regenerated cellulose, lyocell and polylactate, and also materials of synthetic origin such as polyester, polyamide, polyacrylonitrile, polypropylene and polyurethane or else mixtures thereof.

These materials can be present in the form of fibers (wadding, webs), rovings (fly yarn, sliver), yarns (singles, thread, folded yarns), knits (formed-loop knit, drawn-loop knit, warp-knit), wovens (plain, twirl or satin/sateen, weft velvets (cord, wire velvet) or double-wovens cut open (warp velvet, plush, chiffon) or uncut (spacer fabrics) or other sheetlike textile substrates such as stitchbondeds, webs and self-supporting films.

Particular preference is given to cellulose fiber materials which are present as a sheet of threads or as a rope of threads.

For the purposes of the present invention, dyes are dyes which are known to the skilled artisan for dyeing textile materials.

Dyes suitable for dyeing cellulose-containing materials are, in particular, reactive dyes, vat dyes, indigoid dyes such as, in particular, indigo, sulfur dyes and direct dyes. Dyes suitable for dyeing polyester are disperse dyes and dyes suitable for dyeing polyimide and wool are, in particular, acid dyes or reactive dyes.

The dyes mentioned are known, commercially available and extensively described in the literature, for example in the Colour Index published by the British Society of Dyers and Colourists and the American Association of Textile Chemists and Colorists.

The process of the present invention is particularly useful for dyeing cellulosic fibers, of cotton in particular, with indigo. The indigo is preferably used as leucoindigo, i.e., in reduced form.

The process of the present invention utilizes the dyes in the form of concentrated dye systems. These preferably contain dye in amounts of 2% to 40% by weight, based on the entire dye system, and amounts of 5% to 20% by weight are particularly preferred.

Useful concentrated dye systems include, in particular, dye solutions, dye dispersions, dye foams and dye aerosols. In the concentrated dye system present in the form of a solution, this solution comprises, in particular, an aqueous solution of a water-soluble dye, which contains the dye in the abovementioned amounts. Examples are aqueous solutions of reactive dyes, vat dyes in reduced form or leucoindigo. In the case of indigo, the aqueous solution of leucoindigo is obtainable by reducing indigo with a reducing agent, in particular with sodium dithionite. Preference, however, is given to using a commercially available so-called indigo solution which contains leucoindigo prepared by catalytic hydrogenation of indigo.

It is particularly preferable for the dye solution to be applied to the sheetlike textile material uniformly and finely.

This can be accomplished using a gas-kinetic device for example. A suction device therein, placed on one side and transversely to the direction of transport, generates in the sheetlike textile material a negative pressure difference relative to the inert ambient atmosphere while at the same time, on the other side of the sheetlike textile material, a device finely distributes the dye solution into the inert atmosphere uniformly across the width of the sheetlike textile material.

The device for finely distributing the dye solution functions for example mechanically by means of dies or other spraying devices or by means of ultrasound.

It is further preferable to use an aqueous dye solution in admixture with a nonpolar solvent. Suitable nonpolar solvents are for example perchloro-ethylene and trichloroethylene.

The mixing ratio of water to nonpolar solvent is in particular from 10 to 100 ml, more preferably 15 to 80 ml, of water per liter of nonpolar solvent. After application of this mixture and exhaustion of the dye onto the sheetlike textile material, the nonpolar solvent is completely or substantially evaporated on thermal treatment.

In one version of this process, the aqueous dye solution and the nonpolar solvent are converted into an emulsion by means of an emulsifier. Suitable emulsifiers are in particular cation-active surfactants.

They are preferably used in amounts of 0.05% to 2.5% and more preferably 0.5% to 2.0% by weight, based on the total system of dye solution and nonpolar solvent.

Water-insoluble dyes, such as disperse dyes in particular, are preferably used in the form of a dispersion, for which the disperse dye is dispersed in water by means of suitable dispersants. Suitable dispersants are known to the skilled artisan and commercially available.

In one preferred embodiment of the process of the present invention, the concentrated dye system is present as a foam. Suitable foams are obtainable by foaming up an aqueous dye solution by means of an inert gas, nitrogen in particular, in a commercially available foam generator. Suitable foam generators can be constructed as dynamic or static mixers and are described for example in DE 25 23 062 and U.S. Pat. No. 4,118,526.

In general, the foaming is accomplished with the assistance of a foam-former. Suitable foam-formers are, in particular, anionic or nonionic surfactants, which are known and commercially available. Suitable surfactants are described for example in EP 0 162 018.

The foaming can further be carried out in the presence of further auxiliaries. Wetting agents capable of enhancing the penetration by the dye of the sheetlike textile material can be added for example. Such wetting agents are commercially available, and the Sera® Wet D-IS product is particularly suitable in the case of cellulose fibers.

Wetting agents are preferably used in amounts of 1% to 20% and more preferably in amounts of 2% to 8%, all based on the mixture to be foamed. Foaming can further be effected in the presence of fixing agents. Such agents are commercially available, and the Lava® Fix FF product is particularly suitable. Fixing agents are preferably used in amounts of 1% to 15% and more preferably in amounts of 2% to 8%, all based on the mixture to be foamed. Since the foam should ideally rapidly and completely collapse after its application to the sheetlike textile material, the sheetlike textile material can be impregnated beforehand with auxiliaries that accelerate the collapse of the foam on the substrate.

Similarly, the sheetlike textile material can be heated or cooled before the foam is applied thereto in order to likewise accelerate the collapse of the foam on the sheetlike textile material via the temperature difference relative to the foam.

Suitable auxiliaries that accelerate the collapse of the foam on the substrate are for example alcohols, hydrophobic fillers and silicone compounds. Such compounds are commercially available, for example as Sera® Air M-Top, Sera® Air M-HTS and Sera® Foam 58 K.

They are preferably used in amounts of 0.01% to 2.0% and more preferably in amounts of 0.02% to 1.0% by weight, all based on the concentrated dye system.

In a further preferred embodiment of the process of the present invention, the concentrated dye system is present as an aerosol. Suitable aerosols are obtainable by atomizing an aqueous dye solution. Atomizing can be effected for example via high-speed rotors or by means of one- or two-material nozzles. Appropriate devices are commercially available.

Preferably, the aerosol is formed in a chamber which is filled with inert gas, particularly nitrogen, and which more preferably surrounds the sheetlike textile material to be dyed, ensuring direct application.

When a two-material nozzle is used, an inert gas is used as propellant gas, particularly nitrogen.

The concentrated dye systems mentioned are applied to the sheetlike textile material in a total amount of 1% to 25% by weight, preferably in amounts of 5% to 20% by weight. The exact amount follows from the dye content of the concentrated dye system used and also from the desired depth of shade of the dyed material.

The amounts of dye applied, in terms of pure dye, vary with the type of dye and the desired depth of shade and range particularly from 0.5% to 10% by weight and more preferably from 1% to 8% by weight of dye, based on the sheetlike textile material.

The recited amounts of concentrated dye system are applied to the sheetlike textile material in two or more sub-steps, preferably 2 to 10 sub-steps and more preferably 2 to 6 sub-steps.

The total amount of concentrated dye system can be divided up uniformly between the sub-steps, the same amount being applied in each and every sub-step. However, different amounts can also be applied in each and every sub-step that add up to the total amount to be applied. More particularly, the stepwise application of concentrated application system can take place linearly, meaning that the amount per sub-step is the same; progressively, meaning that the amounts per sub-step increase; degressively, meaning that the amounts per sub-step become smaller; or arbitrarily, meaning that the amounts per sub-step are the same or different. In the progressive mode, the amounts applied per sub-step can increase regularly or irregularly. The same holds for the degressive mode, meaning that the amounts applied per sub-step become smaller on a regular or irregular basis. In one particular embodiment of the process of the present invention, different dyes are applied in the various sub-steps. These different dyes can be two or more dyes of the same class of dye, i.e., for example two or more reactive dyes. They can also be dyes of different classes of dye, for example indigo and a sulfur dye.

For example, one dye can be applied in the first and last sub-steps and another dye in the other sub-steps. Similarly, it is also possible for only the first or last sub-step or the middle one or two or more middle ones to differ from the others.

It is preferable to employ the minimum add-on technique for application in each and every sub-step. Minimum add-on means that the concentrated dye system is in each and every sub-step applied in such small amounts that capillary extraction of the solvent, or liquid phase, causes exceedance of the solubility limit of the dye and hence its precipitation on or in the sheetlike textile material. This immediately induces the bonding of the dye to the fiber.

It can be sensible for the separation, caused by capillary extraction, of solvent and dye to be augmented/accelerated. This can be accomplished for example by supplying energy to evaporate some of the solvent.

Applying the concentrated dye systems to the sheetlike textile materials can be done by following any known method. More particularly, it is done by means of known application systems or minimum add-on systems, for example foam application systems, spray nozzle systems and sucking devices.

When the concentrated dye system is applied in the form of a foam, this can be accomplished in particular by employing known processes as described for example in DE 25 23 062, EP 0 162 018 A1 and EP 1 591 578 A2.

To achieve a uniform distribution for the concentrated dye system, it is preferable to use an auxiliary that regulates surface tension. Suitable auxiliaries are for example anionic and nonionic surfactants. Such surfactants are commercially available, for example as Sera® Wet D-IS. They are preferably used in amounts of 0.1% to 1.0% and more preferably in amounts of 0.2% to 0.4% by weight, based on the concentrated dye system.

The concentrated dye systems are, in particular, applied uniformly across the width and length of the sheetlike textile material. However, it is also possible to apply the concentrated dye systems partially only and thereby produce prints.

When air-sensitive dyes are applied, the concentrated dye systems can be applied under an inert gas atmosphere. Nitrogen is a particularly preferred inert gas.

An inert gas atmosphere is particularly preferable when dyeing with indigo.

In the ideal case, the dye becomes automatically fixed on the sheetlike textile material after each and every sub-step and no further processing steps have to be carried out between the sub-steps. This applies particularly to dyeing with indigo in that the leucoindigo applied becomes automatically and immediately oxidized to indigo and fixed on access of atmospheric oxygen.

In the case of other classes of dye in particular, it is possible/necessary to insert, between the individual sub-steps, further processing steps, for example a drying step, an oxidizing step by means of an oxidative liquor or a thermal treatment (thermosoling).

After the complete amount of dye has been applied, additional fixation of the dye through an additional physical or chemical process is not absolutely necessary, but can contribute to enhancing the fixation yield. Nor is there similarly any need for a subsequent clearing of the dyed sheetlike textile material, i.e., particularly the rinsing, washing and soaping steps required according to the prior art, but it can be carried out to enhance the fastness level of the dyeing.

It is preferable to apply the concentrated dye system in a treatment chamber surrounding the sheetlike textile material not just when the concentrated dye system is present as an aerosol but also when it is present as a solution, dispersion or foam. If necessary, and preferably in the case of dyeing with indigo, this chamber has been supplied with inert gas, particularly nitrogen.

In addition, the treatment chamber may have disposed upstream of it a device that removes the air in the sheetlike textile material.

For example, the sheetlike textile material is led through a steam lock into a space which is filled with saturated steam and in which the steam displaces and replaces the adherent air. After passing through a further lock in the traveling direction of the sheetlike textile material, the sheetlike textile material is cooled by means of a cooling drum and the steam, which now condenses, leaves behind an underpressure whereby the space draws in an inert gas, particularly nitrogen. The sheetlike textile material thus rendered airless finally passes through a further lock into the actual dyeing machine/treatment chamber.

It is also possible to equip a treatment chamber with two or more application systems, so that all sub-steps of the process of the present invention take place during one pass of the sheetlike textile material through the treatment chamber.

The process of the present invention is notable in particular for an appreciable reduction in the equipment needed to dye a textile substrate.

FIG. 1 shows a course of the process of the present invention as exemplified for dyeing cotton warp threads with indigo in a vertical aerosol chamber. The warp threads (2) are present on a warp beam carrier (1) and pass horizontally from the lower side through a pair of squeezed rolls (3) to find a vertical squeeze nip. In the squeeze nip, the air in the warp threads is very largely expressed in the downward direction and, after emergence from the squeeze nip, is replaced by the nitrogen which flows in the opposite direction out of the inlet shaft (4) of the aerosol chamber (5) and is policed by a pressure sensor. Spray arms (6) are disposed in the aerosol chamber (5) on both sides and transversely to the sheet of warp threads traveling through. The dye-containing aerosol for dyeing the sheet of warp threads is generated by two-material nozzles which are distributed on the spray arms (6) such that a uniform aerosol medium is produced over the entire width of the sheet of warp threads. Nitrogen in particular is used as propellant gas. The sheet of warp threads dyed in the aerosol chamber (5) exits the aerosol chamber (5) in a cloud of nitrogen via the outlet shaft (7) to transfer via change of direction rolls (8) into the skying sector (9) where the oxidation of the leucoindigo to indigo takes place.

Compared with prior art processes, i.e., for warp threads using the customary open-width dyeing machines, the entire hitherto required "wet end", i.e., troughs with squeeze rolls for wetting or predyeing, troughs and squeeze rolls for dyeing with intervening skying sectors, troughs and squeeze rolls for rinsing, can be dispensed with, similarly heated cylinders for predrying the wet warp threads prior to sizing.

The capital cost of a dyeing device which operates according to the process of the present invention is therefore distinctly reduced compared with a prior art device, since the expenditure for machine material such as troughs, squeeze rolls, pipework, substrate-guiding elements is appreciably reduced in terms of numbers thereof required.

The saving of this expenditure on equipment also results in appreciable savings for operating costs in the form of heating energy, the electrical power requirements of the multi-motor drive of the squeeze rolls, and also the pump motors required for circulating the liquor in dyeing troughs. A further important saving is that of reduced water consumption due to elimination of the wash water (6 to 8 l/kg of dyed warp threads) and the recurring exchange of the liquor volumes in the wetting, dyeing and rinsing troughs (8000 l to 11 000 l per change), which then of course also does not end up in the wastewater. Because there is no longer any interim oxidation there is also no longer any need for processing auxiliaries such as, for example, reducing agents for the dyeing liquor.

Furthermore, the process of the present invention reduces or even eliminates rinsing of the dyed material after dye application.

Finally, personnel costs are reduced by the greatly reduced size of the plant and also by the appreciably reduced need for measuring technology (pH value, redox potential, dye concentration, salt content and liquor circulation rate).

The process of the present invention has a whole series of further advantages. It provides a distinct improvement in fastness, particularly in terms of the ISO 105×12 color fastness to rubbing. The proportion of non-merchandizable material generated in the process of the present invention (due to hue/depth of shade variation, unevenness of dye uptake across width and length of a batch, stoppage marks and broken ends) is reduced to almost zero. The process of the present invention makes it possible to dye short batches (from about 50 m in length) economically, which is not possible using existing dyeing technology.

A change in coloring can take place on the substrate being treated without the plant having to be stopped and refitted.

Owing to the reduced extent to which the textile material is drawn in, the warp spacing continually applied as the substrate passes through current yarn sheet dyeing ranges can be dispensed with. It is therefore possible to use a fabric runner at the start and the end of the batch and thereby further minimize losses due to plant stoppage.

EXAMPLE

Dyeing a Warp Yarn Sheet from Reduced Indigo Aerosol Medium

The dyeing is effected on a plant as per FIG. 1 and is controlled as follows:

Prior to the start of the dyeing, the aerosol chamber (5) is flooded with nitrogen to remove the air, i.e., the oxygen, present therein. This is done via the two-material nozzles on the spray arms (6). At the same time, the precirculation of the dyeing liquor from a collecting vessel via liquor feed lines to the spray arms (6) and back via liquor return lines to the collecting vessel is started. During this prerunning phase, the desired liquor add-on is set via flow meters and associated control valves. To maintain a constant admission pressure at liquor feed lines, pressure sensors and control valves are used to set and maintain the desired line pressure during the entire dyeing phase. Once this presetting phase has ended, the squeeze rolls (4) are closed and the process is started. Once the warp yarn sheet has reached its target speed, the control valves for the liquor feed of all two-material nozzles in the aerosol chamber (5) are cleared by opening the control valves via the pressure previously set at the pressure regulator. At the same time, the control valves in the liquor return lines are closed. The aerosol medium is produced in the aerosol chamber (5) with the aid of the propellant gas which is previously streamed into the chamber through all two-material nozzles and the traveling warp yarn sheet is dyed. During the dyeing phase, the closed nitrogenated collecting vessel is supplied from a stock reservoir vessel via an automatic level controller. The nitrogen atmosphere in the collecting vessel is adjusted to varying pressure conditions by a separate supply device and a control system composed of pressure sensor and control valves. The liquor left behind in the aerosol chamber (5) during the dyeing phase from the aerosol medium is collected in a channel at the inlet to the chamber, and returned via a level controller consisting of level sensor, pump and control valve into the collecting vessel for re-use.

The warp yarn sheet is then led into the skying sector (9) where it is led via multiple guide rolls, spaced apart 30 to 300 cm, through a freely accessible atmosphere. The leucoindigo is oxidized therein to indigo by atmospheric oxygen. The residence time in the skying sector is between 5 and 180 seconds.

The dyed material obtained, when compared with conventionally dyed material having the same depth of shade, has a more pronounced ring dyeing which, moreover, is producible with greater control. This makes it possible, in the subsequent washing of the made-up textile material, to achieve a simpler washdown of the dye to the desired degree in order that the appearance/look desired by the consumer may be achieved. This is accompanied by a saving of wash water, textile auxiliaries and energy for the washer.

Similarly, the process of the present invention which can be regarded as a forced application of dye to textile material, provides a more homogeneous appearance to the substrate, since the dye is applied level and, unlike the existing dyeing technique, does not have to be taken up by the substrate, the dyeability of which varies locally, in an exhaust process.

The ISO 105×12 fastness to rubbing is 2.5 for the product dyed as per the process described above and 1.5 for a comparable product dyed as per the prior art.

A similar improvement of 3 to 3-4 is obtained in the tests for fastness to dry rubbing.

What is claimed is:

1. A process for dyeing sheetlike textile materials with a dye, which comprises applying a concentrated dye system in a total amount of 1% to 25% by weight, based on the textile material, to the textile material in two or more sub-steps and the dye being fixed on the textile material after each and every sub-step.

2. The process as claimed in claim 1, wherein the sheetlike textile material is a cellulose fiber material present as a sheet of threads or as a rope of threads.

3. The process as claimed in claim 1, wherein indigo or sulfur dye is used.

4. The process as claimed in claim 2, wherein indigo or sulfur dye is used.

5. The process as claimed in claim 1, wherein the concentrated dye system is present as a dye solution, a dye dispersion, a dye foam or a dye aerosol.

6. The process as claimed in claim 4, wherein the concentrated dye system is present as a dye solution, a dye dispersion, a dye foam or a dye aerosol.

7. The process as claimed in claim 1, wherein the concentrated dye system contains dye in amounts of 2% to 40% by weight, based on the entire dye system.

8. The process as claimed in claim 6, wherein the concentrated dye system contains dye in amounts of 2% to 40% by weight, based on the entire dye system.

9. The process as claimed in claim 1, wherein the concentrated dye system is present as an aqueous solution, a foam or an aerosol of leucoindigo.

10. The process as claimed in claim 8, wherein the concentrated dye system is present as an aqueous solution, a foam or an aerosol of leucoindigo.

11. The process as claimed in claim 1, comprising 2 to 10 sub-steps.

12. The process as claimed in claim 10, comprising 2 to 10 sub-steps.

13. The process as claimed in claim 1, wherein different dyes are applied in the sub-steps.

14. The process as claimed in claim 12, wherein different dyes are applied in the sub-steps.

15. The process as claimed in claim 13, wherein leucoindigo and sulfur dye are applied in the sub-steps.

16. The process as claimed in claim 14, wherein leucoindigo and sulfur dye are applied in the sub-steps.

17. The process as claimed in claim 1, wherein no further processing steps are carried out between the sub-steps.

18. The process as claimed in claim 16, wherein no further processing steps are carried out between the sub-steps.

* * * * *